United States Patent [19]

Trezza

[11] Patent Number: 4,773,201

[45] Date of Patent: Sep. 27, 1988

[54] METHOD AND STRUCTURE FOR ATTACHING BRICK FACING OR THE LIKE TO A SUPPORTING STRUCTURE

[76] Inventor: Ronald Trezza, P.O. Box 764, Melville, N.Y. 11747

[21] Appl. No.: 41,243

[22] Filed: Apr. 21, 1987

[51] Int. Cl.[4] ..... E04C 1/40

[52] U.S. Cl. ..... 52/510; 52/387; 52/442; 52/746; 52/747

[58] Field of Search ..... 52/387, 386, 388, 442, 52/510, 746, 747

[56] References Cited

U.S. PATENT DOCUMENTS

| | | | |
|---|---|---|---|
| 1,704,035 | 3/1929 | Cochran | 52/387 |
| 2,031,680 | 2/1936 | Tuthill | 52/387 X |
| 2,329,610 | 9/1943 | Harman | 52/388 |
| 3,533,206 | 10/1970 | Passeno, Jr. | 52/387 |
| 4,011,702 | 3/1977 | Matyas | 52/387 |
| 4,238,915 | 12/1980 | Yoshida et al. | 52/510 |
| 4,588,458 | 5/1986 | Previsani | 52/746 |

*Primary Examiner*—John E. Murtagh
*Assistant Examiner*—Andrew J. Rudy
*Attorney, Agent, or Firm*—Roberts, Spiecens & Cohen

[57] ABSTRACT

A structure is provided for placing a brick facing on a supporting structure. The arrangement comprises formed sheets which are each provided with parallel channels into which the facing bricks can be placed. The formed sheets are provided with interlocking edges and are moreover provided with linear arrays of holes covered by tape which has two adhesive faces. One of the faces is exposed in the associated channel. The other face is forced through the associated holes to engage with and adhere with the supporting structure. The bricks are placed into the channels and adhere to the tape. Each channel may be provided with a sub-channel which both strengthens the associated sheet and which morever provides a portion of the channel into which the aforesaid tape may be placed.

17 Claims, 1 Drawing Sheet

METHOD AND STRUCTURE FOR ATTACHING BRICK FACING OR THE LIKE TO A SUPPORTING STRUCTURE

FIELD OF INVENTION

This invention relates to brick panel systems and more particularly to systems suitable for facilitating the installation of bricks or the like over a supporting structure.

BACKGROUND

In the construction and decorating fields and the like, it is frequently desirable to provide a supporting structure with a brick facing. Thus, for example, it may be desirable to apply a brick facing to the exterior surface of a dwelling or the like. As another example, it may be desirable to provide an interior surface with a brick facing such as, for example, adjacent a fireplace or the like.

Systems are known for applying brick facings to supporting structures. One such known system involves a brick panel system which may be applied over various types of surfaces. This system consists of an arrangement of aluminum channels which are applied to polystyrene foam or the like by a laminating process consisting of forming a plurality of holes in the aluminum channels and using an adhesive which is injected through the holes to form a mechanical lock with the polystyrene foam. A number of such channels are placed in end-to-end abutting relationship by the utilization of the supporting material which is provided with interlocking tongue and groove arrangements. In this system, however, the adjacent channels are not locked together, other than through the abutting polystyrene foam panels.

SUMMARY OF INVENTION

It is an object of the invention to provide an improved system of brick facing supports which is easy to install and provides a more rigorous locking together of adjacent channels.

It is another object of the invention to provide an improved brick facing system which is readily employed in the field and which is less subject to improper installation.

Yet another object of the invention is to provide an improved brick facing supporting system which has improved dimensional stability and which is capable of being utilized with equal facility in interior and exterior applications.

In achieving the above and other objects of the invention, there is provided a structure surfacing arrangement comprising a sheet defining a plane, parallel partitions on one side of the sheet dividing the same into parallel channels which are open in the same direction, first and second of these partitions being at opposite extremities of the sheet. The above-mentioned first partition is of a U-shaped cross-section and thereby defines a receptacle opening opposite to the above-mentioned direction. The second partition is adapted to fit into this receptacle whereby when a plurality of said arrangements are juxtaposed and parallel, the second partitions can be interlocked with the first partitions, thereby to provide a dimensionally stable arrangement.

As will be shown hereinafter, the remaining partitions are equidistantly located between the first and second partitions and are constituted by doubled up portions of the sheet. These partitions are generally and preferably of the same height.

As a feature of the invention, the sheet is provided with at least one linear array of openings, the arrangement comprising an adhesive tape extending along and over each of these arrays in adhering relationship with the sheet. The adhesive tape is adapted for being pressed through the openings to stick the arrangement to the supporting structure. The tape advantageously and in accordance with the preferred embodiment of the invention includes opposite faces and adhesive on both of these faces. One of the faces faces away from the sheet and is provided with a removable cover. The holes are preferably of circular conformation with a diameter, for example, of about ¼ of an inch.

The sheet and partitions mentioned above are preferably of a monolithic aluminum stock. According to another advantageous relationship, each of the channels is is provided with a sub-channel. This has the effect of strengthening the structure and providing a depression in which the aforementioned tape can be accommodated.

To enable the tape to perform as has been indicated above, it is preferably of a closed-cell waterproof plastic such as, for example, urethane or polyurethane foam. The bricks adhere to this plastic and are located in the aforementioned channels. In addition, fastening means such as nails, may extend through the sheet into the supporting structure.

According to the method of the invention, the above-mentioned metal sheet is formed into channels adapted for receiving the bricks and arrays of holes are aligned in the channels. The holes are covered with an adhesive tape having two faces covered with adhesive. The thusly-formed sheet is placed against the supporting structure and the tape is forced through the holes to adhere to the structure. The bricks are placed in the channels to adhere to the tape. As also implied above, the system is derived from utilization of a plurality of sheets which are placed into abutting relationship along the edges thereof and the edges are interlocked together and not through the intermediary of another supporting structure.

The above and other objects, features and advantages of the invention will be found in the following Detailed Description as illustrated in the accompanying drawing.

DETAILED DESCRIPTION

Figure 1:
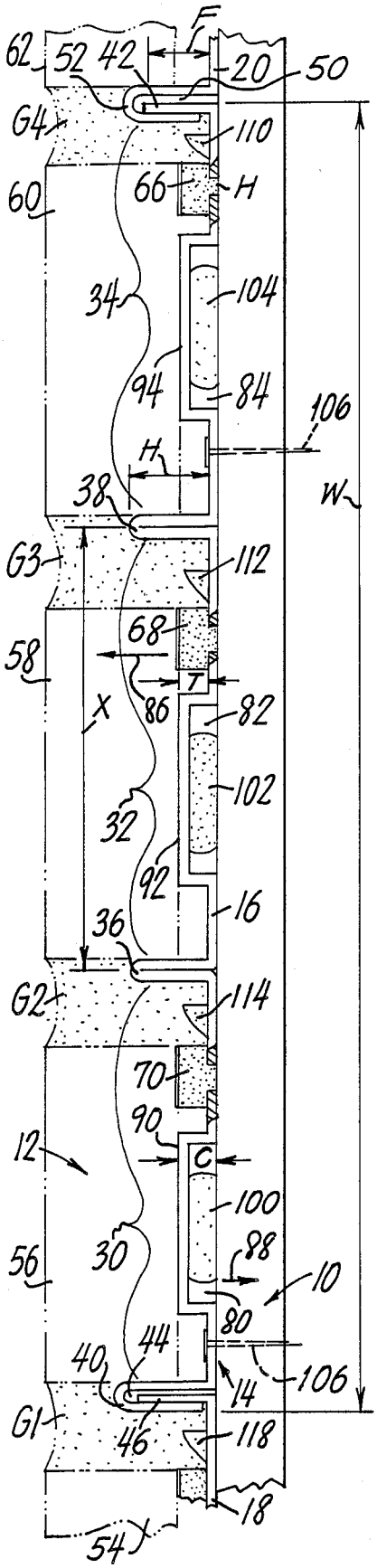
FIG. 1 is a side view partly in section showing a supporting system of the invention installed on a supporting structure and, in turn, supporting a brick facing.

In the drawing the supporting structure is indicated at 10, the brick facing is indicated at 12 and the arrangement of the invention is indicated at 14. The arrangement 14 consists of a plurality of sheets. One sheet 16 is indicated in its entirety and fragmentary portions of adjoining sheets 18 and 20 are indicated in edgewise abutting relationship with an interlocking connection to be discussed in greater detail hereinbelow.

Figure 2:
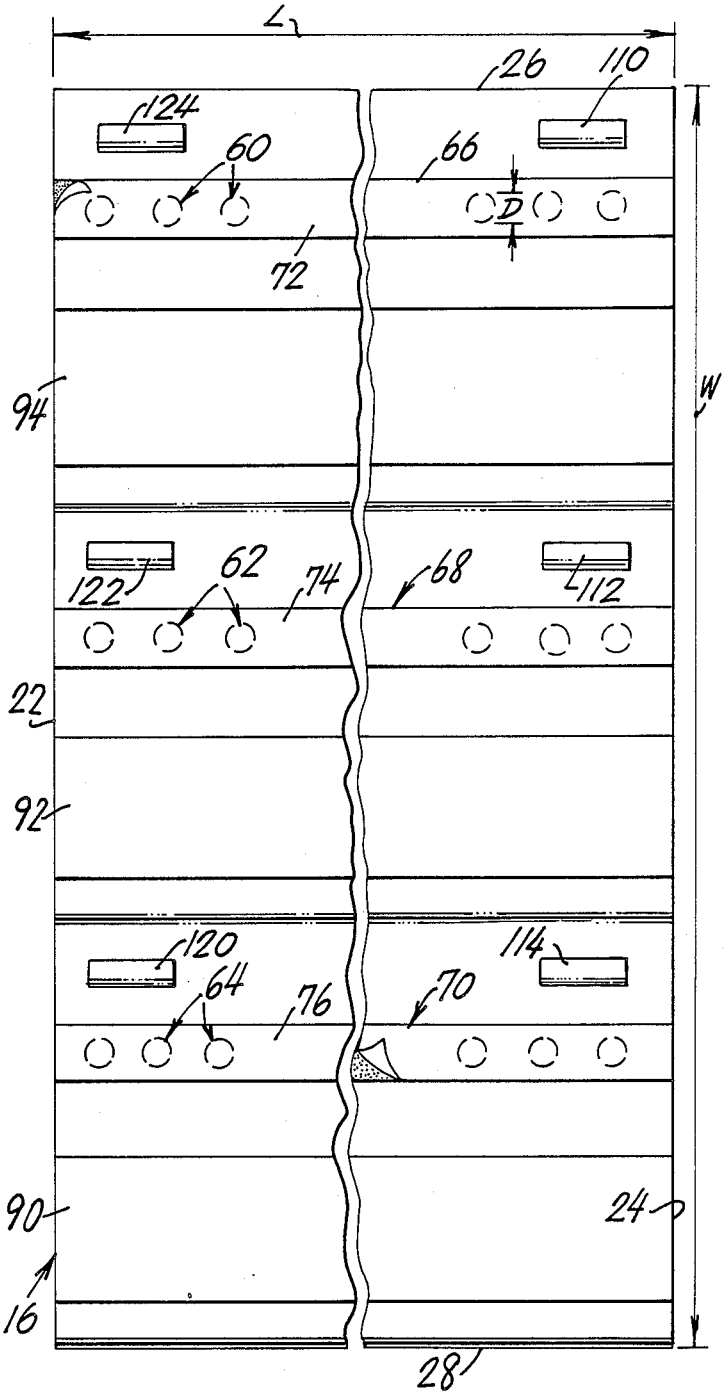
FIG. 2 is a front plan view of a sheet constituting a part of the system of the invention, the sheet being shown in reduced scale relative to FIG. 1.

As is best seen in FIG. 2, the sheet of the invention is of rectangular conformation having lateral edges 22 and 24 and upper and lower edges 26 and 28. The width W indicated in FIGS. 1 and 2 may be of a wide variety of sizes, but, for example, in a preferred embodiment, this width is 8¼". The length of the sheet as indicated at L in FIG. 2 may also be a wide variety of dimensions. Conventional dimensions lie in the range of 48 to 144". These width and length dimensions are given by way of example and are not limiting of the invention.

Each sheet in the preferred embodiment is divided into a plurality of channels 30, 32 and 34. A greater number of channels is, of course, possible. These channels may be regarded as defined by a plurality of partitions such as indicated at 36 and 38. These partitions are located equidistantly between two peripheral partitions indicated at 40 and 42. The partition 40 is of a U-shaped cross-section, thereby defining a receptacle 44. The partition 42 is a simple flange. The simple flange 42 on one peripheral edge of each of the associated sheet is intended to interlock by being accommodated in the receptacle 44 mentioned hereinabove. One such engagement is illustrated by way of example with flange 46 of sheet 18 inter-engaging with partition 40 of sheet 16. Another such engagement or interlocking arrangement appears with the flange 42 being engaged in the receptacle 50 of U-shaped partition 52 of sheet 20.

Also illustrated in FIG. 1 are a plurality of bricks 54, 56, 58, 60 and 62. These bricks are accommodated within the respective channels and are fastened therein by a technique to be described below.

Each sheet (for example, the sheet 16 in FIG. 2) is provided with a linear array of holes. One such array is indicated at 60 in FIG. 2, a second array is indicated at 62 and a third array is indicated at 64. Each linear array of holes consists of a plurality of preferably circular holes having, for example, a dimension D which is in the range of ¼ of an inch plus or minus 1/16 of an inch. This dimension can vary widely provided that the functions to be ascribed thereto are enabled.

Each array is covered by a strip of tape such as indicated at 66, 68 and 70. These tapes overly the respective arrays of holes. The tape is a double-faced tape, the lower face against the sheet 16 bearing a coating of adhesive. The upper face of the tape as well bears an adhesive coating. Moreover, the upper face of the tape prior to the final step of utilization is covered by a strip of paper indicated at 72, 74 and 76. This paper is removed when the time comes to press the respective bricks against the same.

The sheets are moreover provided with sub-channels. One sub-channel is indicated at 80 with the additional sub-channels being indicated at 82 and 84. Whereas the main channels open in the direction indicated by arrow 86, the sub-channels open in the direction indicated by the arrow 88. The provision of the sub-channels provides for a strengthening of the respective sheets and, moreover, provides for a space within which the various tapes are accommodated. The depth of the sub-channels is indicated, by way of example, at C which dimension may, for example, be in the order of magnitude of 1/32 of an inch. This dimension can also vary substantially provided that the necessary functions are provided for. The dimension of the space within which the respective tapes are accommodated is indicated at T. This dimension may be, for example, 1/64 of an inch and is adequate for the thickness of the associated tape. Thus, the various bricks rest against the faces 90, 92 and 94 of the respective sub-channels and rest as well against the outer faces of the tapes 66, 68 and 70.

Example dimensions for the widths of channels such as, for example, channels 30, 32 and 34, may be, for example, that which is indicated at X. This dimension may be, for example, in the order of magnitude of 2 ¾ inches. The breadth of the entire channel as indicated above is indicated at W and may be, for example and as mentioned above, in the order of magnitude of 8 ¼ inches.

To assist in holding the sheets against the supporting structure 10, there may be provided cement in the sub-channels as indicated at 100, 102 and 104. However, the principal means by which a particular sheet is held against the supporting structure is constituted by the various tapes such as 66, 68 and 70 mentioned hereinabove. For application, the sheets are pressed against the supporting structure 10 and by manual or digital operation the respective tapes are forced through the holes of the various arrays and pressed against the supporting structure so that the sheets are held in position by the various tapes. In addition, provision may be made for supplementing the holding power of the tapes and cement by fastening elements in the form of nails, screws or the like, two of which are indicated by way of example at 106.

Other typical examples of dimensions are the heights of the partitions indicated at H. By way of example, this height may be in the order of magnitude of 5/16 of an inch. Also by way of example, the height of the flange such as indicated at 42 may be in the order of magnitude of one-quarter of an inch as indicated at F. Once again, these dimensions are given by way of example only and are not limiting of the invention.

In the method of the invention which relates to mounting brick facings or the like on a supporting structure, there are included the steps of forming the metal sheets into channels adapted for receiving the bricks and aligning arrays of holes in the channels as mentioned above. The holes are as implied above covered with adhesive tape having two faces covered with adhesive. The thusly-formed sheets are placed against the supporting structure and the tape is forced through the holes ( e.g.,at H) to adhere to the supporting structure. The bricks are then placed in the channels to adhere to the tape.

As has also been mentioned above, the adherence of the tape to the supporting structures may be supplemented by the utilization of cement in the sub-channels. The adhesion or positioning of the sheets may furthermore be supplemented by the utilization of fastening elements such as nails, screws, staples or the like.

The method of the invention furthermore comprises forming the sheets with interlocking edges such as has been indicated above, for example, with respect to the inter-engagement of flange 46 into the receptacle 44 of the peripheral partition 40.

In the method of the invention, grout is employed between the bricks as indicated at $G_1$, $G_2$, $G_3$ and $G_4$. To enable the grout to be anchored on hardening, there are provided the weep holes or vents indicated at 110, 112, 114 and 118. These may be spaced across the sheet, say at four inch spacing, as indicated by additional vents at 120, 122 and 124.

There will now be obvious to those skilled in the art, many modifications and variations of the structure set forth above. Thus, for example, the sheets may be fabricated preferably of aluminum of, for example, 0.014–0.024 inches, or the sheets may be fabricated of other preferably non-ferrous metals or plastic or the like. These variations and modifications will not depart from the scope of the invention if defined by the following claims.

What is claimed is:

1. A method for mounting bricks on a supporting structure comprising forming a metal sheet into channels adapted for receiving the bricks, aligning arrays of holes in the channels, covering the holes with adhesive tape having two faces covered with adhesive, placing the thusly formed sheet against said structure, forcing the tape thru the holes to adhere to said structure, and placing the bricks in the channels to adhere to the tape.

2. A method as claimed in claim 1 comprising forming a plurality of sheets including the first said sheet, placing the sheets in abutting relationship along edges thereof, and interlocking said edges.

3. A method as claimed in claim 2 comprising inserting grout between said bricks.

4. A structure surfacing arrangement comprising a sheet defining a plane, parallel partitions on one side of the sheet dividing the same into parallel channels which are open in the same direction, first and second of said partitions being at opposite extremities of said sheet, said first partition being of U-shaped cross-section and thereby defining a receptacle opening opposite to said direction, said second partition being adapted to fit into said receptacle whereby when a plurality of said arrangements are juxtaposed in parallel the second partitions can be interlocked with the first partitions, the remaining partitions being generally equidistantly located between said first and second partitions and being constituted by doubled up portions of said sheet, said sheet being provided with at least one linear array of openings, said arrangement further comprising an adhesive tape extending along and over each said array in adhering relation with said sheet and adapted for being pressed through the openings to stick said arrangement to said structure.

5. An arrangement as claimed in claim 4 wherein said tape includes opposite faces and adhesive on both said faces, one of said faces facing away from said sheet, and a cover on said one face.

6. An arrangement as claimed in claim 4 wherein said holes are circular with a diameter of about one-quarter of an inch.

7. An arrangement as claimed in claim 4 wherein said sheet and partitions are of a monolithic aluminum stock.

8. An arrangement as claimed in claim 4 wherein a sub-channel is provided in each said channel.

9. An arrangement as claimed in claim 8 wherein each sub-channel is parallel to the associated channel and opens in the opposite direction.

10. An arrangement as claimed in claim 9 wherein each sub-channel has a breadth of about 30–60% that of the associated channel.

11. An arrangement as claimed in claim 4 wherein the sheet is rectangular and of a dimension in the order of 8–10 inches by 48–144 inches.

12. An arrangement as claimed in claim 4 wherein the partitions have a height in the order of magnitude of $\frac{1}{4}$ to $\frac{1}{2}$ of an inch.

13. An arrangement as claimed in claim 4 wherein the tape is of a closed-cell waterproof plastic.

14. An arrangement as claimed in claim 13 wherein the plastic is of urethane or polyurethane foam.

15. An arrangement as claimed in claim 4 comprising bricks in said channels.

16. An arrangement as claimed in claim 15 comprising fastening means extending through said sheet into said structure, said sheet being provided with vents, said arrangement further comprising grout between said bricks and engaging in said vents.

17. An arrangement as claimed in claim 4 wherein said partitions are of generally the same height.

* * * * *